US008257109B2

(12) United States Patent
King, Jr. et al.

(10) Patent No.: US 8,257,109 B2
(45) Date of Patent: Sep. 4, 2012

(54) LEVER WATERPROOF WIRE CONNECTORS

(75) Inventors: Lloyd Herbert King, Jr., Jupiter, FL (US); James C. Keeven, O'Fallon, MO (US)

(73) Assignee: The Patent Store LLC, O'Fallon, MO (US)

( * ) Notice: Subject to any disclaimer, the term of this patent is extended or adjusted under 35 U.S.C. 154(b) by 20 days.

(21) Appl. No.: 12/459,625

(22) Filed: Jul. 3, 2009

(65) Prior Publication Data

US 2010/0015839 A1 Jan. 21, 2010

Related U.S. Application Data

(60) Provisional application No. 61/135,102, filed on Jul. 16, 2008.

(51) Int. Cl.
*H01R 4/24* (2006.01)

(52) U.S. Cl. ..... 439/404

(58) Field of Classification Search ..... 439/404, 439/489, 387, 417, 441; 174/87; 361/673; 524/267; 29/872, 885
See application file for complete search history.

(56) References Cited

U.S. PATENT DOCUMENTS

| | | | | |
|---|---|---|---|---|
| 4,464,003 | A * | 8/1984 | Goodman et al. | 439/404 |
| 4,759,726 | A * | 7/1988 | Naylor et al. | 439/441 |
| 5,147,217 | A * | 9/1992 | Neale et al. | 439/403 |
| 5,911,598 | A * | 6/1999 | Pawlenko | 439/521 |
| 7,972,166 | B2 * | 7/2011 | Hiner et al. | 439/441 |
| 2003/0008569 | A1 * | 1/2003 | Matsumoto et al. | 439/835 |
| 2006/0063417 | A1 * | 3/2006 | Liu et al. | 439/404 |
| 2008/0053681 | A1 | 3/2008 | King, Jr. et al. | |

FOREIGN PATENT DOCUMENTS

| | | |
|---|---|---|
| JP | 08-167435 | 6/1996 |

* cited by examiner

*Primary Examiner* — Alexander Gilman
(74) *Attorney, Agent, or Firm* — Jacobson & Johnson LLC

(57) ABSTRACT

A lever push-in wire connector having a sealant therein to enable formation of a waterproof electrical connection by axial insertion of a wire into a chamber contained a resilient conductor protected by the sealant with the resilient conductor displaceable into a waterproof electrical contact with the wire while both the resilient conductor and the wire remain in the presence of the sealant.

24 Claims, 2 Drawing Sheets

LEVER WATERPROOF WIRE CONNECTORS

CROSS REFERENCE TO RELATED APPLICATIONS

This application claims priority from provisional application Ser. No. 61/135,102 filed Jul. 16, 2008 titled Lever Waterproof Wire Connector.

FIELD OF THE INVENTION

This invention relates generally to lever type wire connectors and, more specifically, to waterproof lever type wire connectors.

STATEMENT REGARDING FEDERALLY SPONSORED RESEARCH OR DEVELOPMENT

None

REFERENCE TO A MICROFICHE APPENDIX

None

BACKGROUND OF THE INVENTION

Numerous types of electrical wire connectors for forming bared ends of electrical wires into a waterproof electrical connection through application of force by the user are known in the art. One type of electrical connector relies on inserting the wires into a sealant located between a terminal block and a terminal screw and then squeezing the bared ends of the wire by rotating the terminal screw. The more the user tightens the terminal screw the greater the squeezing and hence an enhanced electrical connection between the bared wire end and the terminal screw.

Another type of electrical wire connector that depends on the force applied by the user is a twist-on wire connector that can be used to form a waterproof electrical connection through rotation of the electrical wires in a spiral shape housing containing a sealant. In the twist-on wire connector, as well as the terminal connector, the more rotational force applied by the user the greater the compression of the wire ends and hence an enhanced electrical connection between the electrical wires.

Another type of electrical wire connector that depends on the force applied by the user, which is used with unstripped wires, is a cutting connector that uses two blades that slice through the insulation layer of the electrical wire and also cut into the sides of the wire, which is located in a waterproof sealant. In each of these prior connectors the electrical connection can be formed in the presence of a waterproof agent through a user generated force sufficient to negate the presence of a waterproofing and electrically insulating agent located on and between the electrical wires.

If a waterproof connection is required in other types of wire connector the conventional methods of waterproofing such wire connectors is to inject a sealant in the wire connector after the wire has been brought into electrical contact with the electrical conductor and bus strip therein. In still another method of waterproofing other types of wire connectors the entire wire connector with the electrical wires secured therein is inserted into a housing containing a sealant, which allows one to encapsulate the entire wire connector, and thereby waterproof the wire connections therein.

One of the other types of electrical connectors, which can be waterproofed by encapsulation, is the lever type wire connector. This type of connector does not rely on the force imparted by a user since a spring force holds the wires in electrical contact with a bus strip. A lever allows one to release the spring to enable the spring to form electrical contact with the electrical wire. The force of the spring is limited by the spring constant of the spring used in the wire connector. Hence the force on the electrical wire by the spring cannot be increased by the user. Consequently, the user lacks the ability to increase the force on electrical wire and thus enhance the electrical connection through use of additional user force.

Although the enhancement of force by the user cannot be used to enhance an electrical connection in the presence of a sealant the applicants have discovered that one can waterproof connections in lever type wire connectors other than through encapsulation.

SUMMARY OF THE INVENTION

A lever push-in wire connector containing a wire displaceable sealant therein to enable the formation of a waterproof electrical connection by axial insertion of the wire into a chamber contained a resilient conductor, a bus strip and a wire displaceable sealant to form a protective waterproof covering over the contact regions between conductors and releasing the lever to bring the resilient conductor into electrical contact with the wire in the presence of the sealant.

In one example a displaceable sealant is placed in the chamber in an uncured state yet when cured the wire displaceable sealant can flex sufficiently so as not to impair axial insertion of the electrical wire or the formation of an electrical connection between the wire engaging members of the lever push-in wire connector.

In another example a viscous displaceable sealant is inserted into the lever push-in wire connector.

DESCRIPTION OF THE PREFERRED EMBODIMENT

Figure 1:
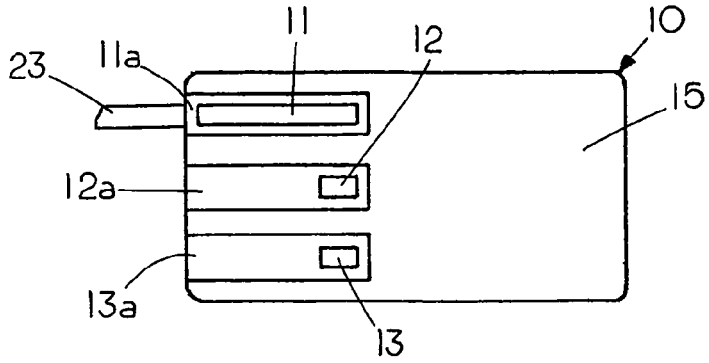
FIG. 1 shows a top view of a lever push-in wire connector.

FIG. 1 is a top view of a lever push-in wire connector 10 for in situ forming a waterproof electrical connection. Wire connector 10 comprises an electrical insulating housing 15 with a set of three independently pivotable levers 11, 12 and 13 mounted in housing 15. As levers 11, 12 and 13 may directly contact an electrical conductor in wire connector 10 the levers 11, 12 and 13 comprise a rigid electrically insulating material. Lever 11 is shown in the down position in a channel 11*a* while lever 12 is shown in the up position in channel 12*a* and lever 13 is also shown in the up position in channel 13*a*.

Figure 2:
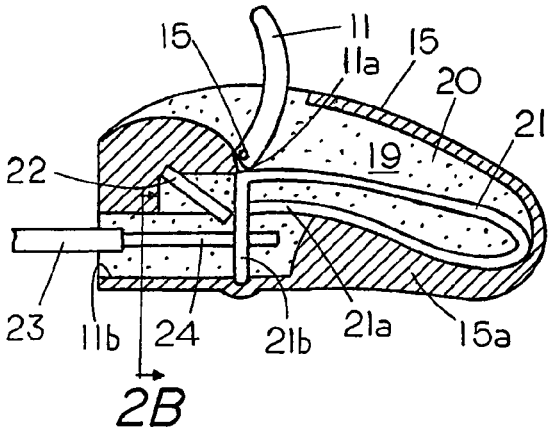
FIG. 2 shows a sectional view of the lever push-in wire connector in a wire receiving condition taken along lines 2-2 of FIG. 2A.
Figure 2A:
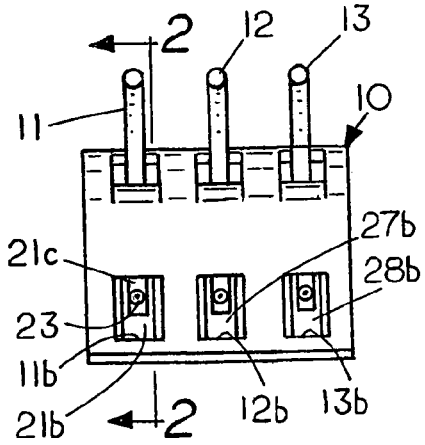
FIG. 2A shows an end view of a lever push-in wire connector containing a sealant therein.

FIG. 2A shows an end view of lever push-in wire connector 10 with levers 11, 12 and 13 in the up position. Associated with lever 11 is a lower wire port or socket 11*b*, associated with lever 12 is a lower wire port or socket 12*b* and associated with lever 13 is a lower wire port or socket 13*b*. With levers in the up position the connector 10 is an open condition where an electrical wire can be inserted into each of the associated wire ports to enable one to form a waterproof electrical connection therein.

Figure 3:
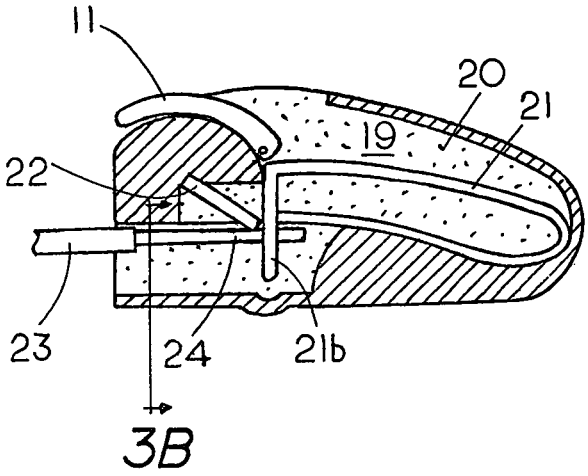
FIG. 3 shows a sectional view of the lever push-in wire connector in a wire engaging condition taken along lines 3-3 of FIG. 3A.
Figure 3A:
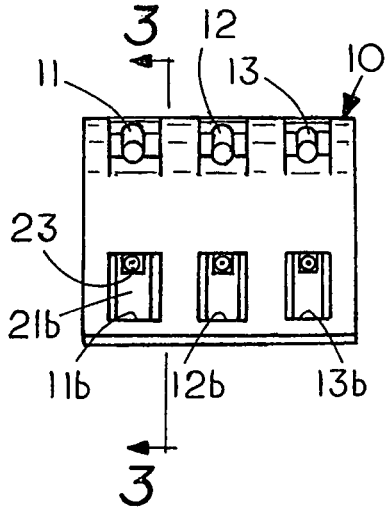
FIG. 3A shows an end view of a lever push-in wire connector containing a sealant therein in the wire engaging condition.

In contrast, FIG. 3A shows an end view of lever push-in wire connector 10 with levers 11, 12 and 13 in the down position. In the down position a resilient conductor in wire connector 10 holds an electrical wire in electrical contact with a common bus strip therein. In the example shown each of the resilient connectors and levers associated with each of the wire ports are identical and only one is described herein.

FIG. 2 shows a cross sectional view taken along lines 2-2 of FIG. 2A revealing housing 15 having a chamber 19 therein. Located in chamber 19 is a wire displaceable sealant 20 therein that encompasses a U shaped electrical conductor 21. U shaped electrical conductor 21 comprises a resilient spring having a first wire engaging end 21*b* and a further end 21 a engaging a bus strip 22. Spring 21 exerts a force that directs the ends of spring away from each other. A lever 11, which is shown in the up position, pivots about a pivot pin 15*c*. In the up condition lever 11 and housing mount 15*a* prevent the spring 21 from spreading apart. That is U shaped spring 21, which is supported by housing mount 15*a* on one side and end of lever 11*a*, is held in compression between the end 11*a* of lever 11 and housing mount 15*a*. With the ends of spring 21 held in position by the lever end 11*a*, when in the up condition, and the housing mount 15*a* the lever push in wire connector is in a wire receiving condition.

In joining two wires into an electrical connection in the lever push-in wire connector 10*a* first bared wire end is axially inserted into the socket 11*b* and into engagement with a common bus strip therein to form electrical contact with the bus strip and a second bared wire end, which is to be electrically joined to the first wire, is axially inserted into the wire socket 12*b* and into engagement with the common bus strip in the push-in connector 10. If needed a third wire can be inserted into wire socket 13*b* and into engagement with the common bus strip in the push-in connector 10.

The lever push-in wire connector 10 allows one form a waterproof electrical connection in a two step process by axially inserting a wire into electrical contact with an electrical conductor in the presence of a wire displaceable sealant 20, which is also an electrical insulator, and moving the associated lever to the down position to release the spring from its compressed condition. In the example of the invention shown a wire displaceable sealant located in the chamber 19 waterproofs the resilient conductors in the chamber 19 so that the moving the lever to the down position allows the end of the resilient spring 21*b* to contact the electrical wire therein so an electrical connection can be made in the presence of the sealant 20 to thereby in situ form a waterproof electrical connection therein.

If desired the wire ports of connector 10 may be covered with a pierceable one-piece cover such as a pierceable film which extends over the socket to protect the sealant in the push-in wire connector 10 from accidentally contacting other items during shipping and handling.

Figure 2B:
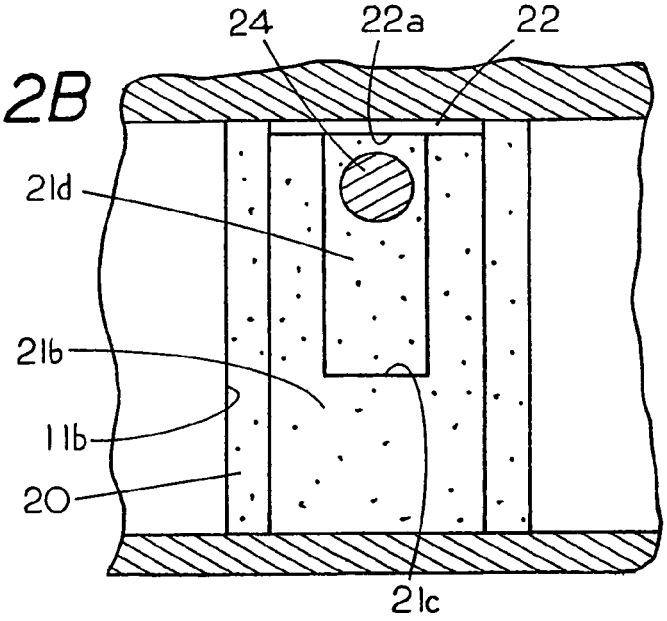
FIG. 2B shows an isolated end view of a wire port with the wire connector in the open condition for receiving an electrical wire.
Figure 3B:
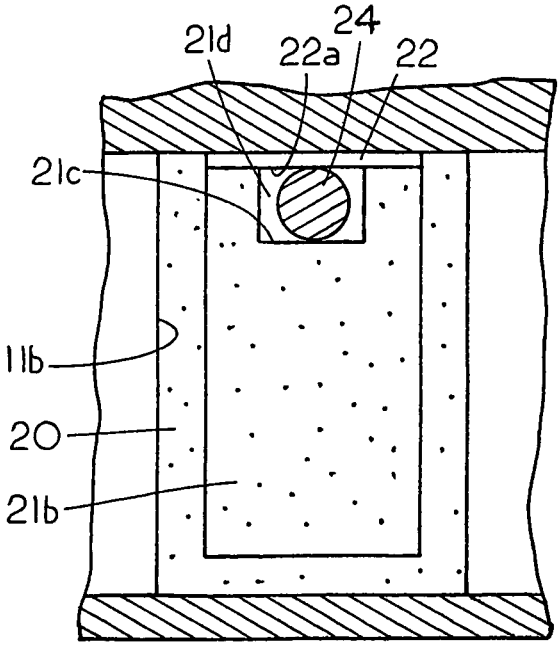
FIG. 3B shows an isolated end view of a wire port with the wire connector in the closed or wire engaging condition.

To illustrate the operation of the lever push-in wire connector reference should be made to FIGS. 2B and 3B. FIG. 2B show the wire port 11*b* in the wire receiving condition. In the wire receiving condition the end 21*b* of spring 21 includes a rectangular shaped wire receiving opening 21*d* with a lower wire engaging edge 21*c* extending along the lower end of opening 21*d*. A stripped or bared wire 24 is shown in opening 21*d* with wire 24 positioned between bus strip edge 22*a* and wire engaging edge 21*c*. Sealant 20 is present and encompasses the end 21*b* of spring 21 as well as the wire 24. As can be seen from FIG. 2B when connector 10 is in the wire receiving condition an electrical wire 24 can be inserted into the sealant and into the opening 21*d* between wire engaging edge 22*a* and wire engaging edge 21*c*.

FIG. 3B shows the end 21*b* of spring 21 in the wire engaging condition. In the wire engaging condition the lever 11 is in the down position (see FIG. 3A), which allows spring 21 to expand thereby bringing spring end 21*b* into engagement with an electrical wire 23. In the wire engaging condition the wire engaging edge 21*c* of spring 21*b* and the wire engaging edge 22*a* of bus strip 22 form a vise like grip on opposite sides of wire 23 therebetween to form a waterproof electrical connection in the presence of sealant 20. Thus a feature of the invention is the method of connecting two wires into a waterproof electrical connection by axially inserting a first wire into a first wire port 11*b* of a lever push-in wire connector having a chamber 19 containing a sealant 20 protecting a bus strip 22 and a resilient conductor 21, which is held in an open condition by a lever 11, latching the lever 11 to bring the resilient conductor 21 into electrically conducting engagement with the first wire 23 while the first wire 23 and the resilient conductor 21 remain in the presence of the sealant and axially inserting a second wire into a second wire port 12*b* of the lever push-in wire connector; and latching a further lever 12 to bring the resilient conductor 21 into electrically conducting engagement with the second wire while the first wire and the resilient conductor remain in a waterproof condition in the presence of the sealant.

The sealant 20, which is a waterproof sealant, is located in the lever push-in wire connector is characterized as a displaceable sealant that can be forcibly displaced yet remain in a water proofing condition. A wire and spring displaceable sealant is sufficiently viscous so as to be normally retainable within the lever push-in wire connector during handling and storage of the lever push-in wire connector, yet yieldable and self healing to form a waterproof covering over a wire inserted therein. An example of a type of sealant that may be used is a gel sealant although still other types of sealants such as silicone sealants that may be used.

Gel sealants are commercially available in liquid form i.e. an uncured state and are often used for vibration damping. The gel sealant, when in the liquid or uncured state, is poured or placed into the chamber 19 in the push-in connector 10 containing moveable parts such as the resilient conductor 21 and lever 11. Since the sealant is in liquid form with low viscosity the sealant 20 flows around any movable parts. Once in position the sealant sets or cures to form a waterproof sealant that has sufficient cohesiveness so as to retain itself within the housing 15 in a ready to use condition. Once cured the gel sealant is capable of yielding in response to conductor or spring movement as well as axial insertion of a wire into engagement with the conductor as well as being self healing to form a waterproof covering over an electrical connection between an electrical wire inserted between the resilient conductor and the bus strip in the lever push-in wire connector.

If one wants to ensure that no pockets of air are retained in the chamber in the lever push-in wire connector the air can be removed from the chamber 19 before injecting the sealant in the chamber 19. As an alternate method, an opening can be placed in the top portion of the housing 15 so that air is forced out as the sealant is injected therein. A further option is to have the ports extending upward as the sealant is directed into the chamber in the lever push-in wire connector so air can be forced out of the chamber as sealant is introduced therein. Sealants that can be placed in lever push-in wire connector, for example in assembled lever push-in wire connectors, can be either in liquid form or in viscous form. An example of a sealant in liquid form is a curable gel that is commercially available and generally comprises two parts that may either be mixed in the wire connector chamber or before placing the curable gel in the chamber of the lever push-in wire connector. The use of a curable gel in liquid form allows the gel, while still in the liquid state, to flow around and encapsulate or protect the wire contacting surfaces components in the chamber including the moving part or parts of the lever push-in wire connector.

Another method for introducing the sealant into an assembled or partially assembled lever push-in wire connector is to force or inject a viscous sealant into one of the ports until the sealant begins to appear in the other ports. It has been found that as the sealant 20 flows from one port to another port through the chamber the sealant flows around the wire connecting surfaces in the lever push-in wire connector. Also, in flowing from port to port air can be forced from the chambers to provide a waterproof covering around the wire connecting surfaces that contact a wire inserted therein. The method of port injection can also be used if the lever push-in wire connector contains multiple ports, in such a case the sealant may be injected or forced into one or more of the ports.

While the introduction of sealant into the lever push-in wire connector may be stopped based on a visual indication, such as the sealant becoming visible in another port, it also may be stopped based on a known volume of sealant injected into the lever push-in wire connector. Also, the amount of sealant injected into the lever push-in wire connector may vary depending on the wiring application. For example, in some applications it may be desired that sealant not extend outside the ports of the lever push-in wire connector and in other applications one may want the sealant to extend outside the ports of the lever push-in wire connectors and onto the housing. Thus one example of the invention is a lever waterproof lever push-in wire connector comprising a housing 15 having a chamber 19 therein and a pivotable lever 11 with a resilient conductor 21 located in the chamber 19 with the resilient conductor having a wire engaging edge 21*c* extending at least partially across a wire port 11*b* in the housing 15 when the wire connector is in an unlatched condition; and a wire displaceable sealant 20 located in the chamber 19 with the wire displaceable sealant waterproofing the resilient conductor 21 in the chamber so that axial insertion of a wire into the wire port 11*b* can extend into the sealant 20 and through an opening 21*d* in the resilient conductor 21 so that when the pivotable lever 11 is brought to the latched position the wire engaging edge 21*c* of the resilient connector 21 is brought into electrical engagement in presence of the displaceable sealant 20 to form a waterproof electrical connection between the wire and the resilient conductor 21. As can be seen in FIG. 2 the sole means of forming electrical contact with the bus strip 22 is through pressure contact between the bus strip 22 and the resilient conductor 21 in the presence of the wire displaceable sealant.

Thus the invention includes the method of making a waterproof lever push-in wire connector without encapsulation of the entire connector and without requiring increased pressure from the user by forming a lever push-in wire connector housing having a first port 11*b* and a second port 12*b* connected to a chamber 19, placing wire connecting surfaces 21*c* and 22 with at least one of the wire connecting surfaces comprising a moving part in the chamber to form a lever push-in wire connector and directing a sealant 20 into the first port 11*b* or the second port 12*b* until the sealant 20 forms a protective covering over the wire connecting surfaces in the chamber.

In the method of prefilling the connector with waterproofing material one can stop directing the sealant 20 into the first port 11 prior to the sealant being forced from the second port 12 or by injecting a known volume of sealant into the first port. In an alternate method one can the forming a lever push-in wire connector by directing a liquid sealant into the first port and allowing the liquid sealant to cure therein.

We claim:

1. A waterproof lever push-in wire connector comprising:
- a housing having a wire port and a chamber therein;
- a wire displaceable sealant located in the chamber;
- a bus strip having a wire engaging corner edge;
- a resilient conductor laterally spaced from said bus strip, said resilient conductor comprising a resilient spring located in the chamber with the resilient spring having an opening with a wire engaging edge extending at least partially across the wire port in the housing with the wire engaging corner edge of the bus strip and the wire engaging edge of the resilient spring laterally offset from each other;
- a pivot pin located in the chamber and within the sealant; and
- a pivotable lever having a first end extending into the sealant in the chamber a with the lever pivotable about the pivot pin while the first end is in engagement with the resilient spring and a second end is located outside the sealant in the chamber so that pivoting the pivotable lever about the pivot pin releases the spring from the compressed condition to bring the wire engaging edge of the spring into electrical engagement with a first side of the wire and the wire engaging corner edge of the bus strip into laterally offset electrical engagement with an opposite side of the wire in the presence of the wire displaceable sealant to thereby form a waterproof electrical connection between the wire and the bus strip.

2. The waterproof lever push-in wire connector of claim 1 including the housing having a bus strip and a second wire port for engaging a further wire therein.

3. The waterproof lever push-in wire connector of claim 2 wherein the wire displaceable sealant is viscous and an electrical insulator.

4. The waterproof lever push-in wire connector of claim 3 wherein the resilient conductor comprises a U shaped conductor.

5. The waterproof lever push-in wire connector of claim 4 wherein the sole means of forming electrical contact with the bus strip is through pressure contact between the bus strip and the resilient conductor in the presence of the wire displaceable sealant.

6. The waterproof lever push-in wire connector of claim 1 wherein the wire displaceable sealant comprises silicone.

7. The waterproof lever push in wire connector of claim 1 for connecting two wires into a waterproof electrical connection comprising:
- a further wire port of the lever push-in wire connector having a further chamber therein;
- a further resilient conductor held in an open condition by a further lever;
- a sealant located in the further chamber, said sealant for waterproofing a bus strip and the further resilient conductor; and a further wire, said further wire axially inserted into the further wire port, said further wire brought into engagement with the resilient conductor by latching the further lever while the further wire and the further resilient conductor remain in a waterproof condition in the presence of the sealant.

8. The waterproof lever push-in wire connector of claim 7 wherein the sealant in a liquid state in the chamber of the lever push-in wire connector is allowed to cure to a gel state.

9. The waterproof lever push-in wire connector of claim 8 forming electrical contact on opposite sides of the first wire while the first wire is located in the sealant.

10. The waterproof lever push-in wire connector of claim 8 including the step of stripping the end of the wire and the end of the further wire before axially inserting either the wire or the further wire into the push-in connector.

11. The waterproof lever push-in wire connector of claim 7 the sealant is forced into the chamber through one of the wire ports in the lever push-in wire connector.

12. The method of making a waterproof lever push-in wire connector comprising:

forming a lever push-in wire connector housing having a chamber therein;

placing wire connecting surfaces laterally spaced from each other with at least one of the wire connecting surfaces having at least one moving part in an unlatched condition;

placing a curable sealant in liquid form into the chamber to encompass the at least one moving part; and in situ curing of the sealant to form a self cohesive gel sealant that retains its integrity within the wire connector housing so that a wire end can be inserted therein and the at least one moving part can be brought into a latched condition so that a wire en a in edge of the wire connecting surface having at least one moving part is in lateral offset engagement with a wire engaging corner of the wire connecting surface to form a waterproof electrical connection.

13. The method of claim 12 including the step of placing a curable sealant comprises placing at least two gel components while the viscosity of the gel components is sufficient low so as allow the gel components to flow around the wire connecting surfaces in the chamber and allowing the components to cure to a wire displaceable sealant before axially inserting a wire into the lever push-in wire connector.

14. The method of claim 13 including the step of removing air from the chamber as the gel components in liquid form are placed in the chamber.

15. The method of forming a waterproof electrical connection comprising:

penetrating an interface of a wire displaceable sealant located in a lever push-in wire connector by axially inserting an end of a bared wire into a wire port of a lever push-in wire connector containing a spring conductor having a resiliently restrained wire engaging edge and a wire engaging corner of a bus strip laterally offset from the resiliently restrained wire engaging edge of the spring conductor and encapsulated in the wire displaceable sealant; and pivoting a pivotable lever about a pivot pin to release a retaining force on the spring conductor to bring the resiliently restrained wire engaging edge and a first side of the bared wire and the wire engaging corner edge of the bus strip into laterally offset electrical engagement with an opposite side of the wire while the junctions therebetween remain waterproofed by the presence of the wire displaceable sealant.

16. The method of claim 15 including the step of simultaneously forcing the end of the bared wire between the resiliently restrained edge and the wire engaging corner edge of the bus strip located in the wire displaceable sealant.

17. The method of claim 15 including the step of forcing the end of a further bared wire into engagement with the wire engaging corner edge of the bus strip located in the wire displaceable sealant.

18. The method of claim 17 including the step of simultaneously forcing the ends of the bared wire and of the further bared wire into direct contact with the wire engaging corner edge of the bus strip located in the wire displaceable sealant.

19. A method of making a waterproof lever push-in wire connector comprising:

forming a lever push-in wire connector housing having a first port and a second port connected to a chamber:

placing wire connecting surfaces laterally spaced from each other with at least one of the wire connecting surfaces comprising a moving part in an unlatched condition in the chamber to form a lever push-in wire connector; and directing a sealant into the first port until the sealant forms a protective covering over the wire connecting surfaces in the chamber so that when the at least one moving part is brought into a latched condition a wire engaging edge of the wire connecting surface having at least one moving part is in lateral offset engagement with a wire engaging corner of the wire connecting surface to form a waterproof electrical connection.

20. The method of claim 19 including injecting the sealant into the first port until it appears in the second port to thereby bring sealant into engagement with the wire connecting surfaces therein after an assembly of the lever push-in wire connector.

21. The method of claim 20 wherein directing the sealant into the first port is stopped prior to the sealant being forced from the second port.

22. The method of claim 20 including the step of forming a lever push-in wire connector by directing a liquid sealant into the first port and allowing the liquid sealant to cure therein.

23. The method of claim 20 including the step of forming a lever push-in wire connector by injecting a known volume of a sealant into the first port.

24. The method of claim 20 including the step of forming a push-in wire connector with additional ports connected to the chamber and directing a sealant into one or more of the ports.

* * * * *

UNITED STATES PATENT AND TRADEMARK OFFICE

CERTIFICATE OF CORRECTION

PATENT NO. : 8,257,109 B2
APPLICATION NO. : 12/459625
DATED : September 4, 2012
INVENTOR(S) : King, Jr. et al.

It is certified that error appears in the above-identified patent and that said Letters Patent is hereby corrected as shown below:

Col. 6, Claim 1, line 30 "ant in the chamber a with the lever pivotable about the" should read --ant in the chamber with the lever pivotable about the--

Col. 6, Claim 4, line 49 "a U shaped conductor" should read --a U-shaped conductor--

Col. 6, Claim 7, line 58 "The waterproof lever push in wire connector" should read --The waterproof lever push-in wire connector--

Col. 7, Claim 9, line 11 "forming electrical contact on opposite sides of the first wire" should read --wherein electrical contact on opposite sides of the first wire is formed--

Col. 7, Claim 11, line 18 "the sealant" should read --wherein the sealant--

Col. 7, Claim 13, line 42-43 "while the viscosity of the gel components is sufficient low so as allow" should read --while the viscosity of the gel components is sufficiently low so as to allow--

Col. 8, Claim 20, line 43 "bring sealant" should read --bring the sealant--

Col. 8, Claim 23, line 55 "of a sealant into the first port" should read --of the sealant into the first port--

Col. 8, Claim 24, line 58 "the chamber and directing a sealant" should read --the chamber and directing the sealant--

Signed and Sealed this
Thirteenth Day of November, 2012

David J. Kappos

David J. Kappos
*Director of the United States Patent and Trademark Office*